United States Patent [19]

Ripley

[11] 4,092,638

[45] May 30, 1978

[54] DISPLAY DEVICE EMPLOYING SPECIAL PURPOSE MONOGRAMS

[75] Inventor: Richard Edward Ripley, Attleboro, Mass.

[73] Assignee: Textron Inc., Providence, R.I.

[21] Appl. No.: 776,717

[22] Filed: Mar. 11, 1977

[51] Int. Cl.[2] ..... G09F 9/32

[52] U.S. Cl. ..... 340/336; 58/23 R; 58/50 R

[58] Field of Search ..... 58/23 R, 50 R, 4 A; 340/336, 324 R; 178/30; 350/160 LC; 313/513, 505, 510

[56] References Cited

U.S. PATENT DOCUMENTS

| | | | |
|---|---|---|---|
| 3,719,849 | 3/1973 | Steward | 340/336 |
| 3,971,012 | 7/1976 | Morokawa et al. | 340/336 |
| 3,994,124 | 11/1976 | Fujita | 58/50 R |
| 4,040,048 | 8/1977 | Lien | 340/336 |

*Primary Examiner*—Marshall M. Curtis
*Attorney, Agent, or Firm*—Robert L. Thompson

[57] ABSTRACT

An electric-optic display device having an electrically controllable optical means for selectively indicating one of the seven days of the week by means of a combination of two letters. The device comprises two arrays, a first array composed of a plurality of segments arranged in such a pattern that all of the letters positioned in the first place of the seven combinations expressing the 7 days of the week can be indicated. The second array is composed of a plurality of segments arranged in such a pattern that all of the letters positioned in the second place of the seven combinations can be indicated. The first letters of the days of the week are formed in uppercase letters, the second letters of certain days of some days of the week are formed about one-half as high as the first letters of the days of the week and the second letter of at least one day of the week is formed as a lowercase letter. Each segment of the first array is electrically controlled to indicate any desired day of the week and each segment of the second array is electrically controlled to indicate any desired date of the month.

6 Claims, 8 Drawing Figures

DISPLAY DEVICE EMPLOYING SPECIAL PURPOSE MONOGRAMS

BACKGROUND OF THE INVENTION

This invention relates to an electric-optic display device having electrically controlled optical means which comprises segments or elements which can be selectively energized to indicate the first two letters of the seven days of the week and the dates of the month for use in digital time-pieces such as wrist watches and clocks.

There has been a long-felt recognized need for such a display device prior to my invention.

The closest prior art to the present invention of which I am aware is U.S. Pat. No. 3,971,012 dated July 20, 1976 to Shigera Morokawa, et al, the convention application for which was filed June 18, 1975. The device of the Morokawa et al patent displays all of the abbreviations of the days of the week in uppercase letters which are of the same height and at least one letter, the letter "O", is easily confused with the numeral "0" in the data of the month which follows the day of the week.

BRIEF SUMMARY OF THE INVENTION

One object of this invention is to provide a new photoelectric display device for use in digital timepieces such as wrist watches and clocks to indicate the first two letters of the week and the dates of the month.

Another object is to provide such a display device which is economical to manufacture and is durable in use.

A further object is to provide such a display device in which the letters of the abbreviations of the days of the week cannot be confused with any of the numerals of the dates of the month.

Another object is to provide such a display device in which all characters are easily readable.

Yet a further object is to provide such a display device in which the arrays which indicate the abbreviations of days of the week and the dates of the month can be used to indicate the times of day.

A still further object is to provide such a display device in which the time of the day arrays can be used to display both twelve hours and twenty-four hours.

Further objects and advantages of the invention will be apparent to persons skilled in the art from the following description taken in conjunction with the accompanying drawings.

In general, a display device embodying this invention includes a first array of electrically controllable, elongate display elements selectively energizable in different combinations corresponding to the first letter of any day of the week and a second array of electrically controllable elongate display elements selectively energizable in different combinations corresponding to the second letter of any day of the week. The elements of the first and second arrays each include six linear elements which form an oblong substantially upright frame. Each of them also includes a seventh linear element which extends horizontally across the oblong frame dividing it into an upper and lower half. The first array also includes two V-shaped elements disposed in the halves of an oblong frame in mutually inverted relationship with their vertices pointing toward the seventh element.

The second array also includes an eight linear display element which extends laterally between the linear elements which form the sides of the lower half of the second array, whereby the first letters of the days of the week are formed as uppercase letters, the second letters of some days of the week are about one-half as high as the first letters of the days of the week and the second letter of at least one day of the week is formed as a lowercase letter by selectively energizing the display elements of the first and second arrays. This prevents the user from confusing the letters which form the abbreviations of the days of the week with any of the numerals of the dates of the month.

In a preferred embodiment of the display device, the eight linear display element extends horizontally laterally between the linear elements which form the sides of the lower half of the second array.

In another embodiment, the eighth linear display element extends obliquely laterally from lower left to upper right between the linear elements which form the sides of the lower half of the second array.

In a still further embodiment, the eighth linear element is curve.

In one preferred embodiment, the display elements are liquid-crystal segments.

In another preferred embodiment, the segments are lightemitting diodes.

It will be apparent to persons skilled in the art that this invention has solved the above-described, recognized, long-felt need and satisfied the above stated objects.

DETAILED DESCRIPTION OF THE FIRST EMBODIMENT

Figure 4:
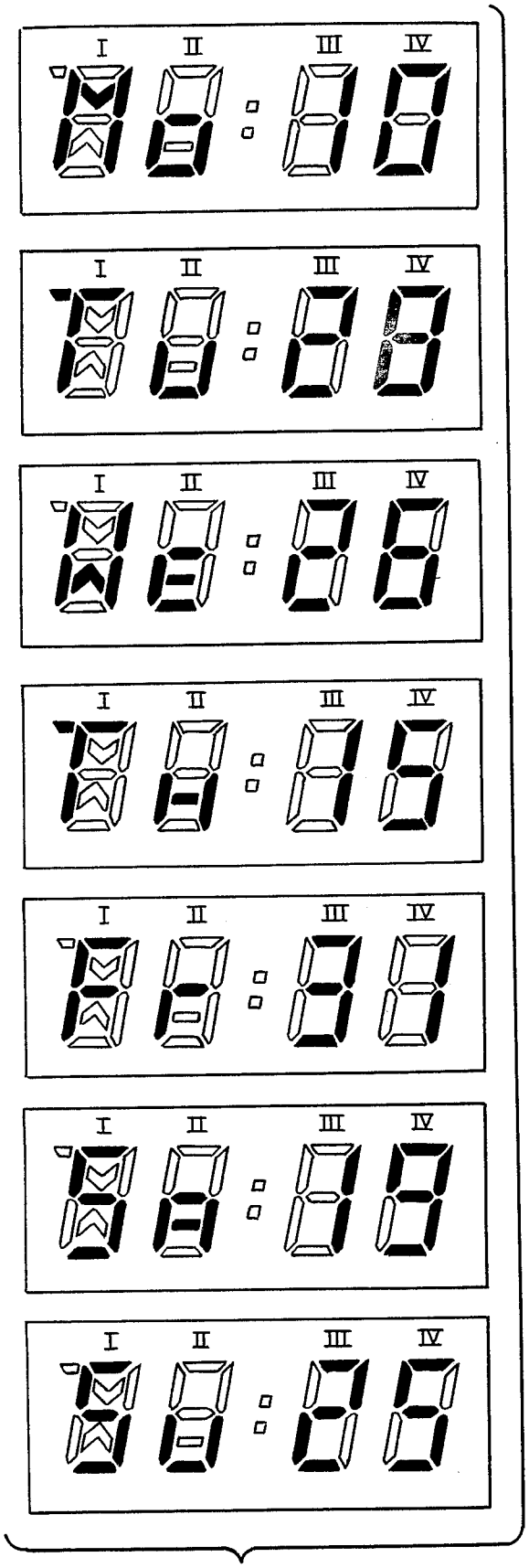
FIG. 4 is a series of views illustrating the display elements of the first embodiment energized to show abbreviations of the seven days of the week, namely Monday through Sunday, followed by different dates.
Figure 1:
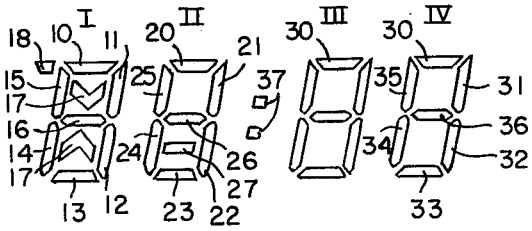
FIG. 1 shows four arrays of electrically controllable elongate display elements which are selectively energizable for use in explaining the first embodiment of the invention.

The display device of this invention includes two arrays which are adapted for use in electronic watches and clocks for use in displaying abbreviations of the days of the week and the dates. It also may include two conventional seven segment arrays for displaying different times of the day.

Referring to FIGS. 1 thru 5 in which the first embodiment is illustrated, the first array I displays the first letters of the days of the week as capital letters and the second array II displays the second letters of the days of the week as smaller letters.

The first array comprises six electrically controllable, selectively energizable linear segments or elements 10, 11, 12, 13, 14 and 15 which forms an oblong substantially upright frame and a seventh electrically controllable, selectively energizable linear element 16 which extends horizontally across the frame to divide it into an upper and a lower half. These segments may be liquid-crystal segments which are well known in the art. The first array also comprises two electrically controllable, selectively energizable V-shaped segments or elements 17 disposed in said halves in mutually inverted relationship with their vertices pointing toward the seventh element 16. In addition, another electrically controllable, selectively energizable segment or element 18 may be provided and its longitudinal axis coincides with the longitudinal axis of the first element 10.

The second array II also comprises six electrically controllable, selectively energizable linear segments or elements 20, 21, 22, 23, 24 and 25 which form an oblong substantially upright frame and a seventh electrically controllable, selectively energizable segment or element 26 which extends across the frame to divide it into an upper and a lower half. The second array also comprises an eighth electrically controllable, selectively energizable linear segment or element 27 which extends laterally between the linear elements 22 and 24 which form sides of the lower half of the second array.

The third and fourth arrays, III and IV, are conventional seven-segment arrays for displaying different times of the day. Each array comprises six electrically controllable, selectively energizable linear segments or elements 30, 31, 32, 33, 34 and 35 which form an oblong substantially upright frame, and a seventh linear element 36 which extends horizontally across the frame to divide it into an upper and a lower half.

The display device also includes a pair of electrically controllable, selectively energizable, generally square segments or elements 37 which would display a colon (:).

Figure 2:
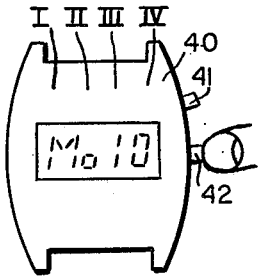
FIG. 2 illustrates the operation of a wrist-watch embodying the first embodiment with the display elements energized to show the day and date, namely Monday the 10th.
Figure 3:
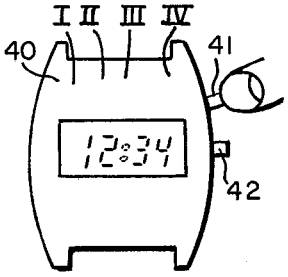
FIG. 3 illustrates the operation of a wrist watch embodying the first embodiment with the display elements energized to show the time of the day, namely 12:34.

As shown in FIGS. 2 and 3, a wrist watch 40 which embodies the display device of this invention includes two manually operated pushers or switches 41 and 42. It also includes an electrically controlled module and customary circuits for digitally displaying time signals and day of the week and date of the month signals.

When the switch 42 is depressed as shown in FIG. 2, a circuit is energized which causes the arrays I, II, III and IV to display the abbreviations of the day of the week and the date of the month. For example, in FIG. 2, "Mo 10" is displayed.

When the switch 41 is depressed as shown in FIG. 3, a circuit is energized which causes the arrays I, II, III and IV to display the time, namely "12:34".

The series of views shown in FIG. 4 illustrate the arrays I, II, III and IV in which the display elements have been energized to show abbreviations of different days of the week and different dates. It is to be noted that the first letters of days of the week are each formed in uppercase letters, whereas at least the majority of the second letters of certain days of the week (namely the letters, O, H, E, U and A) are only about one-half as high as the first letters of the days of the week and that the second letters of at least one day of the week (namely the letter "*r*") is formed as a lowercase letter. It is also to be noted that the "M" is an uppercase letter and the "*o*" in "Mo" is only about one-half the height of the "M", whereas the "0" in "10" is the same height as the "1". Consequently, the "o" in "Mo" is easily distinguishable from the "0" in "10".

Figure 5:
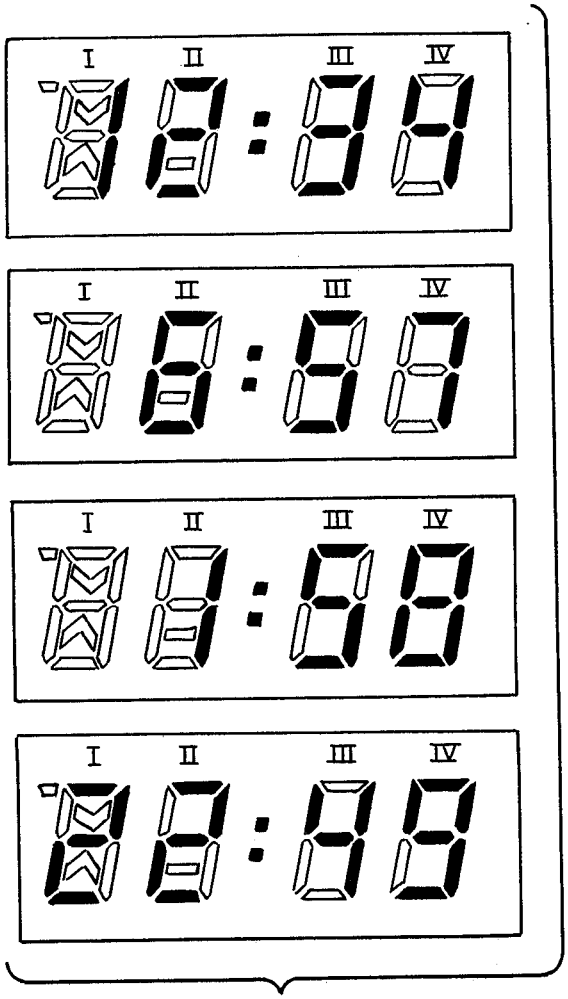
FIG. 5 is a series of views illustrating the display elements of the first embodiment energized to show different times of the day.

The series of views shown in FIG. 5 illustrate the display elements of arrays, I, II, III and IV energized to show different times of the day. It is to be noted that they can be used to display times for a twenty-four hour period.

DETAILED DESCRIPTION OF THE SECOND EMBODIMENT

Figure 6:
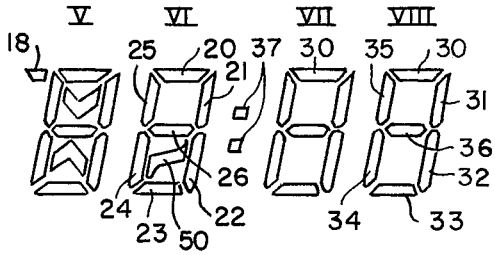
FIG. 6 shows four arrays of electrically controllable elongate display elements which are selectively energizable for use in explaining a second embodiment of the invention.
Figure 7:
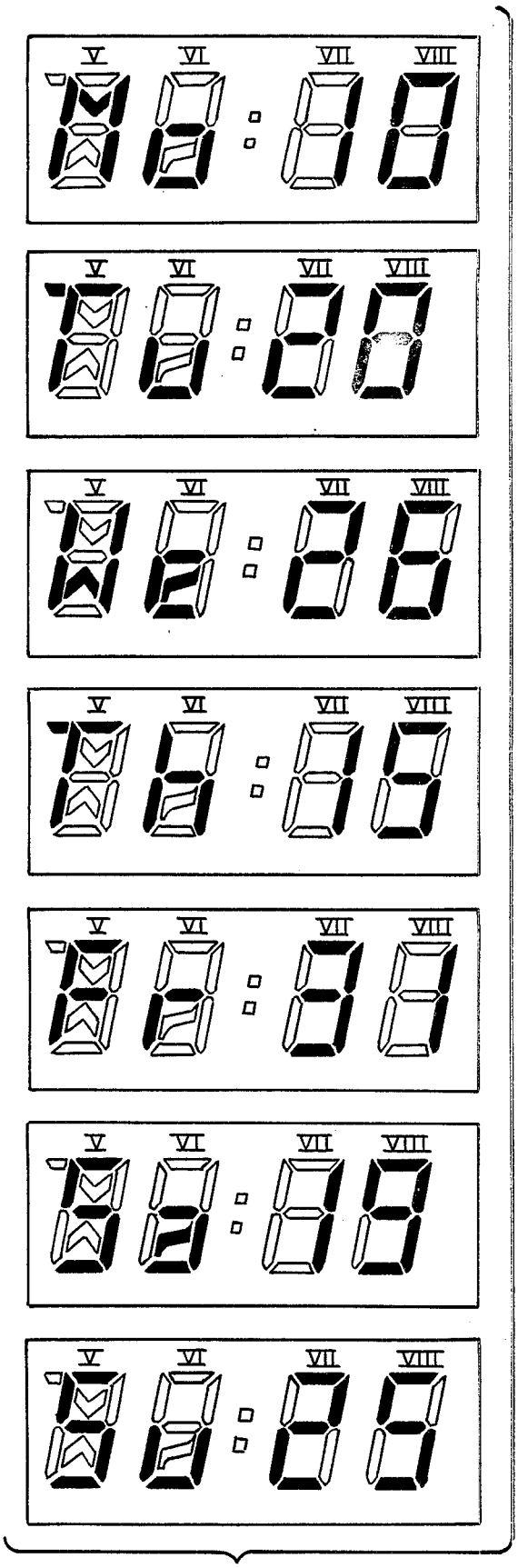
FIG. 7 is a series of views illustrating the display elements of the second embodiment energized to show abbreviations of the seven days of the week, namely Monday thru Sunday, followed by different dates.
Figure 8:
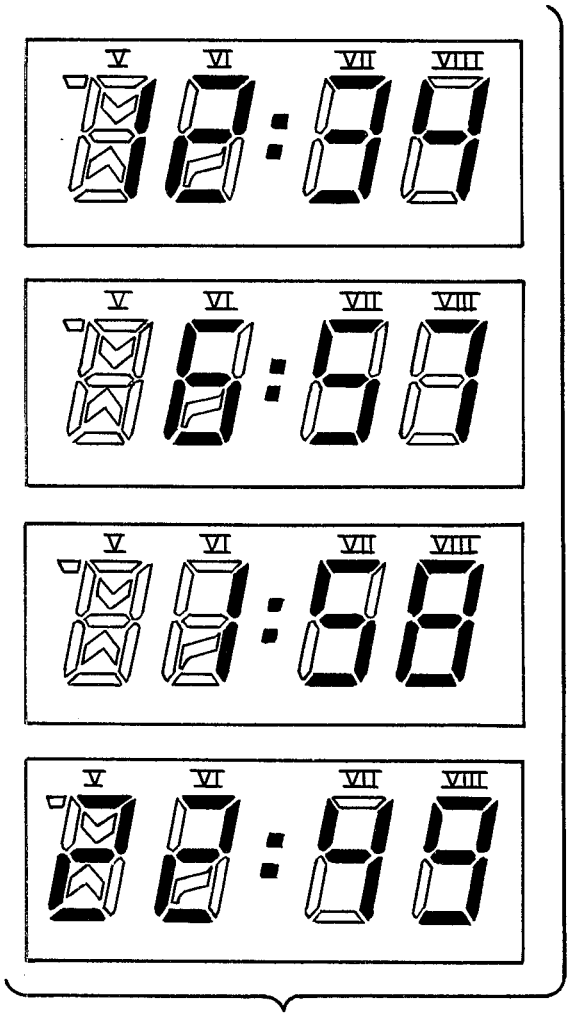
FIG. 8 is a series of views illustrating the display elements of the second embodiment energized to show different times of the day.

This embodiment is shown in FIGS. 6 thru 8 of the drawings. The arrays V, VII and VIII of this second embodiment respectively, are the same as arrays I, III and IV of the first embodiment respectively, and consequently, the same numerals have been used to designate the elements thereof.

Array VI comprises six electrically controllable, selectively energizable linear segments or elements 20, 21, 22, 23, 24 and 25 which form on oblong substantially upright frame and a seventh electrically controllable, selectively energizable linear segment or element 26 which extends across the frame to divide it into an upper and lower half. It also comprises an eighth electrically controllable, selectively energizable segment or element 50 which extends laterally between the linear elements 22 and 24 which form the sides of the lower half of the array VI. It is to be noted that the element 50 extends obliquely laterally from lower left to upper right between the elements 24 and 22 and that it is curved.

Referring to FIG. 7, it will be noted that the "*a*" in Saturday is a lowercase letter as distinguished from the uppercase "A" in Saturday of the first embodiment.

The operation of a watch or clock embodying the second embodiment is the same as the operation of a watch or clock of the first embodiment as described above and consequently it is unnecessary to repeat the description of its operation here.

It will be apparent to persons skilled in the art that display devices embodying this invention have solved the above described, recognized long-felt need and satisfied the above stated objects.

While two desirable embodiments of display devices embodying the invention have been shown in the drawings, it is to be understood that this disclosure is for the purpose of illustration only, and that various changes in shape, proportion and arrangement of parts as well as the substitution of equivalent elements for those shown and described herein may be made without departing from the spirit and scope of the invention as set forth in the appended claims.

I claim:

1. In a device for displaying at least the first and second letters of the days of the week comprising:

a first array of electrically controllable elongate display elements selectively energizable in different combinations corresponding to the first letter of any day of the week, a second array of electrically controllable elongate display elements selectively energizable in different combinations corresponding to the second letter of any day of the week, said elements of said first and said second arrays including six linear elements forming an oblong substantially upright frame and a seventh linear element extending horizontally across said frame to divide it into an upper and lower half, and said first array further including two V-shaped elements disposed in said halves in mutually inverted relationship with vertices pointing toward said seventh element, the improvement comprising, an eight linear display element in said second array extending laterally between the linear elements which form the sides of the lower half of said second array to divide it into two substantially equal parts, whereby the first letters of the days of the week may be formed as uppercase letters, the second letters of some days of the week may be about one-half as high as the first letters of the days of the week and the second letter of at least one day of the week may be formed as a lowercase letter by selectively energizing the display elements of said first and second arrays.

2. A device according to claim 1 wherein said eighth linear display element extends horizontally laterally between the linear elements which form the sides of the lower half of said second array.

3. A device according to claim 1 wherein said eighth linear display element extends obliquely laterally from lower left to upper right between the linear elements which form the sides of the lower half of said second array.

4. A device according to claim 3 wherein said eighth linear display element is curved.

5. A device according to claim 1 wherein said display elements are liquid-crystal segments.

6. A device according to claim 1 wherein said display elements are light-emitting diodes.

* * * * *

UNITED STATES PATENT AND TRADEMARK OFFICE

CERTIFICATE OF CORRECTION

PATENT NO. : 4,092,638

DATED : May 30, 1978

INVENTOR(S) : Richard Edward Ripley

It is certified that error appears in the above-identified patent and that said Letters Patent are hereby corrected as shown below:

Column 1, line 23, change "data" to --date--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*